US006889590B2

(12) United States Patent
Guelou et al.

(10) Patent No.: US 6,889,590 B2
(45) Date of Patent: May 10, 2005

(54) DECOY DEVICE AGAINST WAKE-TRACKING TORPEDOES

(75) Inventors: Yann Guelou, Muret (FR); Philippe Mourry, Ramonville Saint Agne (FR); Christine Gillot, Muret (FR)

(73) Assignee: Etienne Lacroix Tous Artifices S,A, Muret (FR)

( * ) Notice: Subject to any disclaimer, the term of this patent is extended or adjusted under 35 U.S.C. 154(b) by 6 days.

(21) Appl. No.: 10/020,736

(22) Filed: Dec. 11, 2001

(65) Prior Publication Data

US 2002/0185048 A1 Dec. 12, 2002

Related U.S. Application Data

(63) Continuation of application No. 09/319,796, filed as application No. PCT/FR98/02141 on Oct. 7, 1998, now abandoned.

(30) Foreign Application Priority Data

Oct. 9, 1997 (FR) ..... 97 12632

(51) Int. Cl.[7] ..... F41F 5/04
(52) U.S. Cl. ..... 89/1.11; 114/240.4
(58) Field of Search ..... 114/240 A; 89/1.11

(56) References Cited

U.S. PATENT DOCUMENTS

| | | | | | |
|---|---|---|---|---|---|
| 2,637,536 | A | * | 5/1953 | De Ment | 366/348 |
| 3,483,132 | A | | 12/1969 | Bernd | 516/15 |
| 3,506,086 | A | * | 4/1970 | McGann et al. | 181/175 |
| 3,808,940 | A | * | 5/1974 | Schillraff et al. | 89/1.11 |
| 3,841,219 | A | * | 10/1974 | Schillreff | 102/37.6 |
| 3,947,566 | A | | 3/1976 | Sarna et al. | 424/45 |
| 3,947,568 | A | | 3/1976 | Bates et al. | 424/47 |
| 4,286,498 | A | * | 9/1981 | Block et al. | |
| 4,686,212 | A | | 8/1987 | Ducatman et al. | 514/161 |
| 5,127,945 | A | * | 7/1992 | Miller | 106/14.44 |
| 5,144,587 | A | * | 9/1992 | Mason | 367/1 |
| 5,211,957 | A | | 5/1993 | Hagemann et al. | 424/466 |
| 5,721,711 | A | * | 2/1998 | Fine et al. | 367/1 |

FOREIGN PATENT DOCUMENTS

| | | |
|---|---|---|
| DE | 43 22 837 A1 | 7/1993 |
| DE | 43 22 837 | 4/1995 |
| FR | 2660907 | 4/1990 |
| WO | WO 91/16234 | 10/1991 |

OTHER PUBLICATIONS

The Condensed Chemical Dictionary, Van Nostrand Reinhold Company, Ninth Edition, 1977, pp. 71, 72, 823, and 824.*

* cited by examiner

*Primary Examiner*—Michael J Carone
*Assistant Examiner*—Troy Chambers
(74) *Attorney, Agent, or Firm*—Blakely Sokoloff Taylor & Zafman

(57) ABSTRACT

A decoy device for wake-following torpedoes, the device comprising a body of effervescent material that reacts with sea water to generate a cloud of bubbles simulating a phoney wake, the device being characterized in that it has a covering of material that is soluble in sea water which delays the reaction of the effervescent material with sea water.

14 Claims, 2 Drawing Sheets

DECOY DEVICE AGAINST WAKE-TRACKING TORPEDOES

This is a continuation application of Ser. No. 09/319,796 filed Jun. 9, 1999 now abandoned which is a 371 of PCT/FR98/02141 filed Oct. 7, 1998.

BACKGROUND OF THE INVENTION

FIELD OF THE INVENTION

The invention relates to a decoy device for wake-following torpedoes.

BACKGROUND

It is conventional in the art of warfare to use decoys to divert or attract enemy weapons fitted with homing systems.

In particular, at sea, torpedo decoys are already known which are in the form of devices that emit sound signals resembling those from a ship. In this respect reference can advantageously be made to FR-2 660 907 and WO 91/16234.

Also known, in particular from patent application DE 4 322 837, are decoys made of effervescent materials.

BRIEF SUMMARY OF THE INVENTION

The invention proposes a decoy device for wake-following torpedoes, the device comprising a body of effervescent material that reacts with sea water to generate a cloud of bubbles simulating a phoney wake, the device being characterized in that it has a covering of material that is soluble in sea water which delays the reaction of the effervescent material with sea water.

Advantageously, it also has a covering of material that dissolves in sea water that enables the generation of bubbles to be delayed when the device is immersed in sea water.

In particular, the thickness of the covering is advantageously calibrated so that when said device is immersed, the effervescent material begins to react with sea water only after said device has been sinking for a predetermined length of time. Such a covering makes it possible to improve the effectiveness of the device.

For example, in a preferred embodiment, said thickness is calibrated so that the effervescent material does not begin react with sea water until it is at a depth of about 10 meters.

The invention also provides a method of decoying torpedoes, characterized in that devices of the above-specified type are dispersed in the sea from the air.

Other characteristics and advantages appear from the following description. This description is purely illustrative and non-limiting. It should be read with reference to accompanying FIGS. 1 and 2, in which:

DETAILED DESCRIPTION OF THE INVENTION

Figure 1:
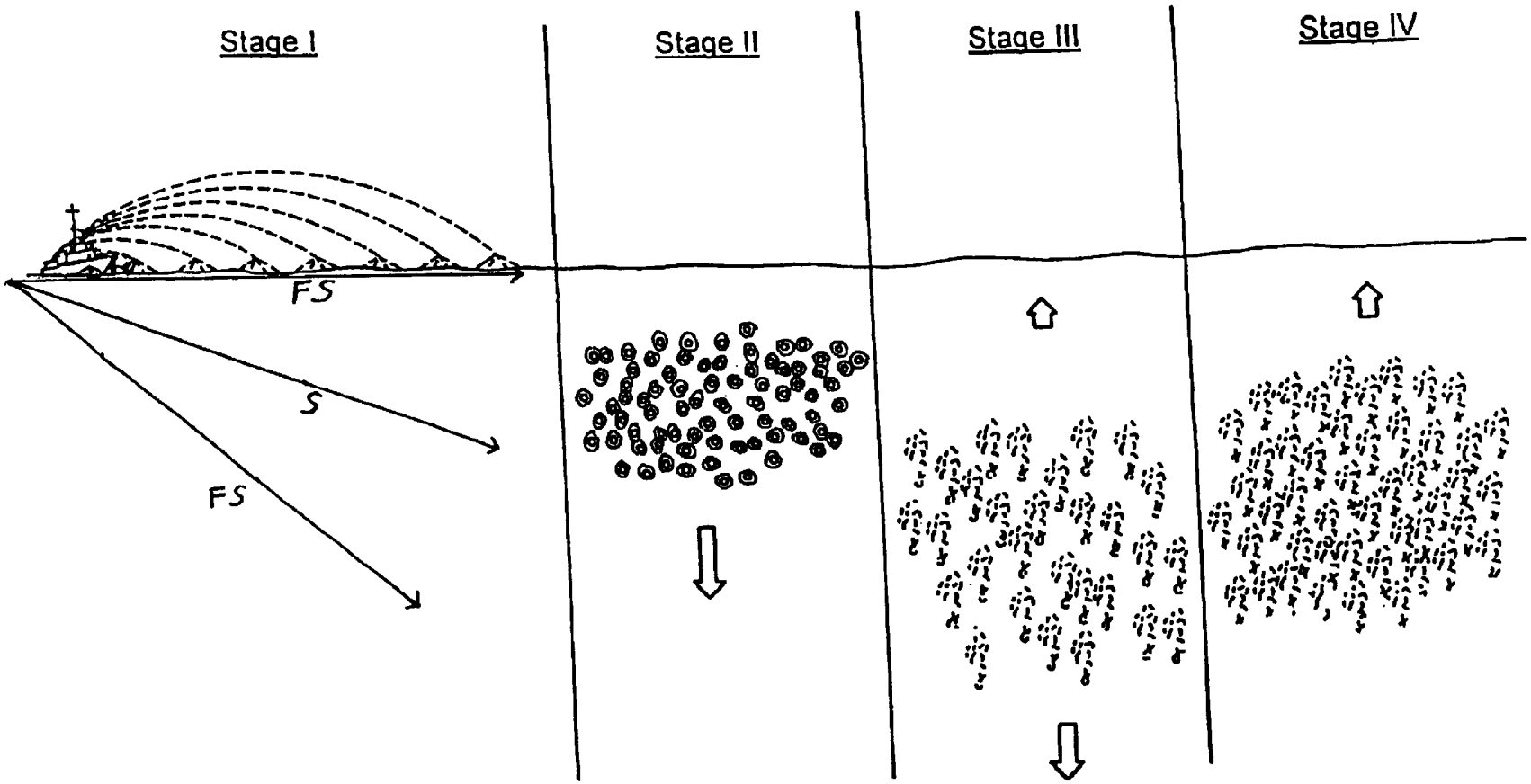
FIG. 1 shows a deployment sequence for a device constituting an embodiment of the invention.

The effervescent body of a decoy device of the invention is preferably a compact of material that is non-polluting and compressible.

The specific gravity of this material must be greater than 1, so as to enable the compact to sink freely to a depth of 10 meters, with its rate of sinking determining the time delay that the covering coating said compact needs to provide.

By way of example, the material can be a stoichiometric mixture of tartaric acid (specific gravity 1.7598) and of sodium hydrogen carbonate (specific gravity, 2.159).

In water, this mixture reacts and causes bubbles of $CO_2$ to be formed by the following reaction:

$$C_4H_6O_4 + 2NaHCO_3 \xrightarrow{H_2O} C_4O_4H_4Na_2 + 2CO_2\uparrow + 2H_2O$$

A similar reaction can be obtained by replacing tartaric acid with citric acid. It is also possible to envisage making the effervescent body out of lithium hydride.

Nevertheless, tartaric acid is preferred given that it is less hygroscopic and that it avoids any self-triggering of the effervescent reaction.

To avoid phenomena of compacts crumbling and to provide a surface that is as regular as possible for covering purposes, the mixtures are compressed with as great a compression ratio as possible, so as to obtain maximum hardness for the compact.

This hardness can be further improved by adding a binder, e.g. of the cellulose type.

Nevertheless, binders tend to inhibit the effervescent action of such compacts, and also tend to cause them to rise to the surface.

It is also possible to add a small quantity (less than 5%) of lubricant to the mixture, e.g. 2% magnesium stearate, so as to prevent seizing while the mixture is being compressed.

The bubbles generated by the effervescent compact at a depth of 10 meters, i.e. at a pressure of 2 bars, need to have dimensions lying in the range 30 $\mu$m to 50 $\mu$m (which corresponds to bubbles at the surface of the water having dimensions lying in the range 38 $\mu$m to 63.4 $\mu$m).

For a given compression ratio of the mixture of the compact, bubble size is mainly a function of the grain size of the raw materials: the finer the raw materials, the smaller the bubbles.

Various grain size ranges can be considered for the particles of the mixture. For example, the diameter of the particles could be less than 100 $\mu$m, or could lie in the range 100 $\mu$m to 200 $\mu$m, or could lie in the range 200 $\mu$m to 315 $\mu$m.

Nevertheless, it has been observed that grain sizes corresponding to particle diameters of less than 100 $\mu$m provide the best compromise in terms of the size of the resulting bubbles (bubble diameter at the surface of the water about 44.7 $\mu$m).

The covering which performs the delay function is made of an organic material.

By way of example, it is constituted by a film made by spraying or depositing a polymer solution on the compact. It can also be implemented in the form of capsules in which the effervescent bodies are enclosed.

An example of an organic material for the covering of the compact is as follows:

- hydroxypropymethyl cellulose and derivatives thereof (ethyl, butyl, etc.);
- vegetable gums (of the guar, agar, pectin, etc. type);
- gums of animal origin (of the xanthane, gelatin, albumin, etc. types);

polyvinyl alcohol (PVAL);

poly(N-vinylpyrrolidone) (PVP); or poly(ethylene oxide) (PEOX).

The shape of the compact is as hemispherical as possible, or else it is cylindrical in shape.

By way of example, the following table gives possible dimensions for various compositions of effervescent compact, and also the sinking speeds which correspond to the various compacts.

| Nature of compact | Ø in mm | Height in mm | Mass in g | Specific gravity | Sinking rate in m/s |
|---|---|---|---|---|---|
| Tartaric A 50% $NaHCO_3$ 50% | 6 | 0.53 | 0.2566 | 1.71 | 0.2 |
| Tartaric A 50% $NaHCO_3$ 50% | 6 | 0.49 | 0.2288 | 1.65 | 0.21 |
| $NaHCO_3$ 50% | 12 | 0.33 | 0.6731 | 1.80 | 0.15 |
| Tartaric A 50% Stearate 0.08% | 12 | 0.33 | 0.6428 | 1.72 | 0.14 |
| 100 μm–200 μm | 6 | 0.43 | 0.1771 | 1.45 | 0.2 |
| $NaHCO_3$ 50% Tartaric A 50% | 6 | 0.4 | 0.1565 | 1.38 | — |
| <100 μm | 12 | 0.17 | 0.2810 | 1.46 | 0.1 |
| Tartaric A 50% $NaHCO_3$ 50% Stearate 0.2% | 12 | 0.15 | 0.2820 | 1.66 | 0.1 |

In addition, the device also advantageously includes ballast-forming means, for the purpose of making it sink faster.

Figure 2:
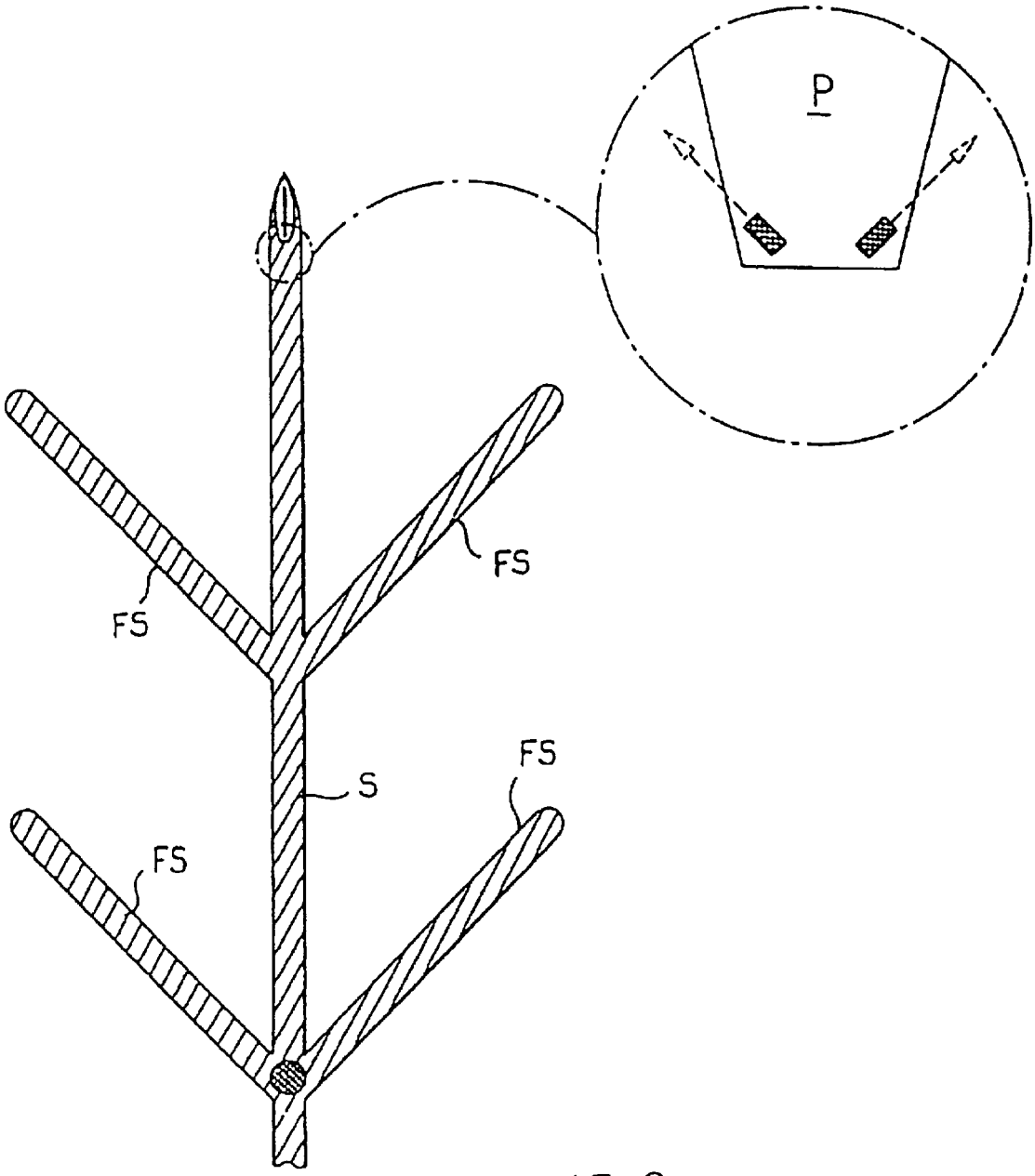
FIG. 2 shows a possible configuration for the distribution of phoney wakes as generated by means of devices proposed by the invention.

FIGS. 1 and 2 show how decoying is deployed with devices of the invention as described above.

These devices are thrown to a distance from the aft deck P of a ship, implementing "dagaie" type dispersion in air, using different firing angles depending on the distances between the points where it is desired to distribute said effervescent devices and the ship (stage I in FIG. 1).

As shown in FIG. 2, the distribution is advantageously on both sides of the axis of the wake S of the ship, possibly together with a certain amount of dispersion so as to provide phoney wakes FS which join the wake S and which can be interpreted by a torpedo as being a change in the direction of the wake.

The devices thrown into the sea sink (stage II in FIG. 1), and then after a certain length of time, once the covering has melted, may begin to generate bubbles (stage III), rapidly reaching steady bubble generating conditions (stage IV).

By following the phoney wake FS (FIG. 2), a torpedo will use up its supply of driving energy before reaching the ship.

Advantageously, this decoying is associated with devices being placed at the intersections between the wake S and the phoney wakes FS, said devices being decharacterization devices and devices for jamming and saturating the acoustic detectors of torpedoes.

What is claimed is:

1. A decoy device for wake-following torpedoes, the device comprising a body of effervescent material that reacts with sea water to generate a cloud of bubbles simulating a phoney wake, wherein the effervescent material has grains in a size range of less than 100 μm, the device being characterized in that it has a covering of material that is soluble in sea water which delays the reaction of the effervescent material with sea water.

2. A device according to claim 1, characterized in that the covering is made of organic material.

3. A device according to claim 2, characterized in that a thickness of the covering is calibrated so that when said device is immersed, the effervescent material begins to react with sea water only after said device is immersed for a predetermined length of time.

4. A device according to any one of claims 1 to 3, characterized in that the covering is made of a material which is hydroxypropymethyl cellulose or a derivative thereof, a gum of vegetable or animal origin, a polyvinyl alcohol, a poly (N-vinylpyrrolidone), a poly (ethylene oxide), or a mixture thereof.

5. A device according to claim 1, characterized in that the effervescent material comprises a mixture of tartaric acid and of sodium hydrogen carbonate.

6. A device according to claim 1, characterized in that the effervescent material comprises a mixture of citric acid and of sodium hydrogen carbonate.

7. A device according to claim 6, characterized in that the mixture is substantially stoichiometric.

8. A device according to claim 1, characterized in that the effervescent material includes a lubricant.

9. A device according to claim 1, characterized in that the effervescent material is such that the bubbles generated thereby at a depth of 10 meters are of dimensions lying in the range 30 μm to 50 μm.

10. A device according to claim 1, characterized in that it further includes ballast-forming means, for the purpose of enabling it to sink faster.

11. A torpedo decoying method comprising dispersing decoy devices in the sea from the air, wherein each device comprises a body of effervescent material that reacts with sea water to generate a cloud of bubbles simulating a phoney wake, each device being characterized in that it has a covering of material that is soluble in sea water which delays the reaction of the effervescent material with sea water.

12. A method according to claim 11, characterized in that the devices are dispersed on either side of the axis of the wake (S) of the ship so as to constitute phoney wakes (FS) meeting the wake (S) of the ship.

13. A decoy device for wake-following torpedoes, the device comprising a body of effervescent material that reacts with sea water to generate a cloud of bubbles simulating a phoney wake, the device being characterized in that it has a covering made of an organic material that is soluble in sea water which delays the reaction of the effervescent material with sea water; and wherein a thickness of the covering is calibrated so that when said device is immersed, the effervescent material begins to react with sea water only after said device has been sinking for a predetermined length of time and is at a depth of about 10 meters.

14. A decoy device for wake-following torpedoes, the device comprising a body of effervescent material that reacts with sea water to generate a cloud of bubbles simulating a phoney wake, the device being characterized in that it has a covering made of an organic material which is hydroxypropymethyl cellulose or a derivative thereof, a gum of vegetable or animal origin, a polyvinyl alcohol, a poly (N-vinylpyrrolidone), a poly (ethylene oxide), or a mixture thereof, that is soluble in sea water which delays the reaction of the effervescent material with sea water; and wherein a thickness of the covering is calibrated so that when said device is immersed, the effervescent material begins to react with sea water only after said device has been sinking for a predetermined length of time and is at a depth of about 10 meters.

* * * * *

UNITED STATES PATENT AND TRADEMARK OFFICE

CERTIFICATE OF CORRECTION

PATENT NO. : 6,889,590 B2
APPLICATION NO. : 10/020736
DATED : May 10, 2005
INVENTOR(S) : Guelou et al.

It is certified that error appears in the above-identified patent and that said Letters Patent is hereby corrected as shown below:

Title Page
In Item [63], Related U.S. Application Data, Line #1, after "filed" please insert -- June 9, 1999 --.

Title Page
In Item [56], U.S. Patent Documents, in reference 3,808,940 please delete "Schillraff" and insert -- Schillreff --.

Signed and Sealed this

Twenty-third Day of October, 2007

JON W. DUDAS
*Director of the United States Patent and Trademark Office*